US008235481B2

(12) United States Patent
Kubo et al.

(10) Patent No.: US 8,235,481 B2
(45) Date of Patent: Aug. 7, 2012

(54) INKJET RECORDING HEAD AND RECORDING APPARATUS

(75) Inventors: Kousuke Kubo, Yokohama (JP); Yoshiyuki Imanaka, Kawasaki (JP); Koichi Omata, Kawasaki (JP); Hideo Tamura, Kawasaki (JP); Takaaki Yamaguchi, Yokohama (JP); Yuuji Tamaru, Yokohama (JP); Ryoji Oohashi, Yokohama (JP); Toshio Negishi, Kawasaki (JP)

(73) Assignee: Canon kabushiki Kaisha, Tokyo (JP)

( * ) Notice: Subject to any disclaimer, the term of this patent is extended or adjusted under 35 U.S.C. 154(b) by 558 days.

(21) Appl. No.: 12/432,531

(22) Filed: Apr. 29, 2009

(65) Prior Publication Data

US 2009/0273626 A1 Nov. 5, 2009

(30) Foreign Application Priority Data

Apr. 30, 2008 (JP) ..... 2008-118811

(51) Int. Cl.
*B41J 29/38* (2006.01)

(52) U.S. Cl. ..... 347/5; 347/9; 347/10; 347/19

(58) Field of Classification Search ..... None
See application file for complete search history.

(56) References Cited

U.S. PATENT DOCUMENTS 5,828,386 A 10/1998 Okada
7,467,864 B2 12/2008 Matsui
2007/0002087 A1* 1/2007 Matsui et al. ..... 347/9

* cited by examiner

*Primary Examiner* — Uyen Chau N Le
*Assistant Examiner* — Chad Smith
(74) *Attorney, Agent, or Firm* — Canon USA Inc IP Division

(57) ABSTRACT

An inkjet recording head includes a connection-state output circuit provided on the recording element substrate of a recording head, where the connection-state output circuit externally transmits data of the connection state of each of input signal ends. An output from the connection-state output circuit is activated when the same logic as that used when signals are pulled up and/or pulled down is used.

6 Claims, 11 Drawing Sheets

H1000

H1000

INKJET RECORDING HEAD AND RECORDING APPARATUS

BACKGROUND OF THE INVENTION

1. Field of the Invention

The present invention relates to an inkjet recording head, and more particularly relates to a circuit provided in the recording head, the circuit being configured to confirm the state of a connection between the recording head and the main body of a recording apparatus.

2. Description of the Related Art

A method of using an electromechanical transducer such as a piezo element and a method of ejecting droplets by using thermal energy are known as typical liquid (ink) ejecting methods that are used for an inkjet recording head mounted on an inkjet recording apparatus. Of the above-described methods, inkjet recording heads configured to heat liquid through an electrothermal conversion element (heater) and eject droplets through the effect of film boiling have become widely available.

A recording apparatus provided with the inkjet recording head can output high-quality text data or image data at a low cost. A unit configured to electrically connect the recording head to the main body of the recording apparatus is provided on the recording head and a carriage on which the recording head is mounted so that the recording head is reciprocated. More specifically, a plurality of contact points is provided on the carriage. When the recording head is mounted on the carriage, the contact points are brought into contact with a plurality of electrical contact points provided on the recording-head side so that an electrical connection is established between the recording head and the main body of the inkjet recording apparatus.

A recording head and a recording apparatus that are provided with a configuration used to monitor the electrical connection state have been known. For example, a record signal, a clock signal used to transfer the record signal, and so forth are transmitted from the main body of the recording apparatus to the input end of the recording head. There are an AND circuit configured to calculate a logical product of control signals used for recording operations performed through the record signal, a recording head provided with an output end used to externally transmit data of the calculation result, and so forth. Thus, the configuration used to monitor the electrical connection state of the recording head is provided on the recording head. Consequently, a disorder on an image such as the missing of record dots, a malfunction in the recording head, the malfunction occurring due to insufficient connections of the contact points, and so forth were reduced. The confirmation and/or monitoring the state of an electrical connection between the head and the recording apparatus was important for a head cartridge that is integrated into an ink tank and that is mounted on the main body of the inkjet recording apparatus in a removable manner. When a malfunction occurred in the head of the head cartridge, it was difficult to use ink contained in the ink tank provided in the head and the ink was wasted.

As described above, the inkjet recording head has been used based on the premise that the inkjet recording head is mounted and/or removed on and/or from the recording apparatus by a user, so as to be replaced with another. When a head cartridge integrated into an ink tank is used, a new inkjet recording head is mounted on the recording apparatus each time ink is consumed. Since the recording head is mounted and/or removed on and/or from the recording apparatus by the user, a system that can confirm the state of the electrical connection between the main body of the recording apparatus and the recording head each time the recording head is mounted and/or removed on and/or from the recording apparatus is preferred. As for the mounting and the removing the recording head, determining whether the recording head is mounted at a predetermined position with stability is preferred. It is important to reduce malfunctions in the recording head, the malfunctions occurring due to an insufficient connection between the recording head and the main body of the recording apparatus, by determining an end with insufficient connection and/or detecting shorting of one end and the other end, for example.

For example, if the recording head is mounted on the recording apparatus while a dust or the like is attached to a part of the electric contact unit of the recording head, the connection may be insufficient only for some ends to which the dust is attached.

According to U.S. Pat. No. 5,828,386, a logical product is calculated for each of signal system input ends used to transmit signals to a recording head. If the level of the output is lower than or equal to a predetermined voltage level, it is determined that a connection between the recording head and an apparatus is insufficient and a warning is issued. In that case, if any single end with insufficient connection is detected, it is determined that there is a malfunction in the recording head itself. Therefore, it has been difficult to detect whether the recording head is mounted on a predetermined position, whether the connection of each end is insufficient, or whether the connections of only some of the ends are insufficient on the recording-apparatus side.

According to U.S. Pat. No. 7,467,864, a circuit configured to output data of the state of a connection between a recording head and a recording apparatus is provided. A latch signal and/or a heater-drive signal transmitted to the recording head is inversed before being transmitted to the circuit so that a noise transmitted from the circuit during data recording does not become a noise affecting recorded data. However, the circuit disclosed in U.S. Pat. No. 7,467,864 is configured to collectively determine whether signals transmitted to the recording head are constant signals instead of separately determining the connection state of a predetermined end.

SUMMARY OF THE INVENTION

Accordingly, the present invention provides an inkjet recording head that can determine an end in an insufficient connection state.

For solving the above-described problems, an inkjet recording head according to an aspect of the present invention can be mounted on a recording apparatus in a removable manner. The inkjet recording head includes an element substrate including a plurality of recording elements, a record data input end provided to transmit record data, a clock signal input end provided to transfer the record data, a drive signal input end provided to transmit a drive signal used to control driving the recording element, and a latch signal input end provided to transmit a signal used to latch the record data through a latch circuit, a connection-state output circuit configured to externally transmit data of the state of a connection between the input ends and the recording apparatus based on signals transmitted from the recording apparatus via the input ends, and a connection-state output end configured to externally transmit data of the result of a calculation performed through the connection-state output circuit. The connection-state output circuit is a circuit configured to activate an output from the connection-state output end when a logic equivalent to a logic used when the record data and the input signals that are transmitted from the input ends are pulled up and/or pulled down is used.

The present invention provides an inkjet recording head that can separately determine the state of a connection between the main body of a recording apparatus and each of signal input ends provided on a recording element substrate of the recording head.

Further features of the present invention will become apparent from the following description of exemplary embodiments with reference to the attached drawings.

DESCRIPTION OF THE EMBODIMENTS

Hereinafter, embodiments of the present invention will be described with reference to the attached drawings.

In this specification, the term "recording" (hereinafter referred to as "printing") denotes generating not only significant information indicating a character, a drawing, and so forth, but also insignificant information. Namely, the term "recording" broadly denotes generating an image, a design, a pattern, and so forth on a recording medium and/or processing a medium. Further, the term "recording" may not denote generating data, the data being actualized so that a person can visually perceive the data.

The term "recording medium" indicates not only paper used for ordinary recording devices but also anything that can accept ink. Namely, the term "recording medium" indicates cloth, a plastic film, a metal board, glass, ceramics, wood, leather, and so forth.

Further, the term "ink" should be broadly defined, as is the case with the above-described term "recording". Namely, the term "ink" indicates liquid that can be applied on the recording medium, and that can be used to generate an image, a design, a pattern, and so forth and/or process the recording medium. In another case, the term "ink" denotes liquid that can be used to process ink. The ink processing denotes, for example, solidifying and/or insolubilizing a colorant included in ink applied on the recording medium.

Further, the term "element substrate" used in the following description does not indicate a simple base including a silicon semiconductor, but denotes a base on which various elements, wiring, and so forth are provided. The expression "on the element substrate" not only indicates the surface of the element substrate, but also the inside of the element substrate, the inside being close to the surface. Further, the term "production" used in the present invention does not indicate simply providing each of separate elements on the base, but forming and manufacturing each of the elements so that the elements are combined into the element substrate by performing processing procedures performed to manufacture a semiconductor circuit, for example.

However, components disclosed in the following embodiments are illustrated by example, and the scope of the present invention is not limited only to the above-described components.

Hereinafter, the configuration of an inkjet recording head according to an embodiment of the present invention, and an inkjet recording apparatus configured to record data by using the above-described recording head will be described.

(Recording Head)

FIGS. 7A, 7B, 8A, 8B, and 9 are diagrams provided to illustrate an appropriate inkjet recording head according to an embodiment of the present invention. Hereinafter, each of components will be described with reference to the above-described drawings.

Figure 7A:
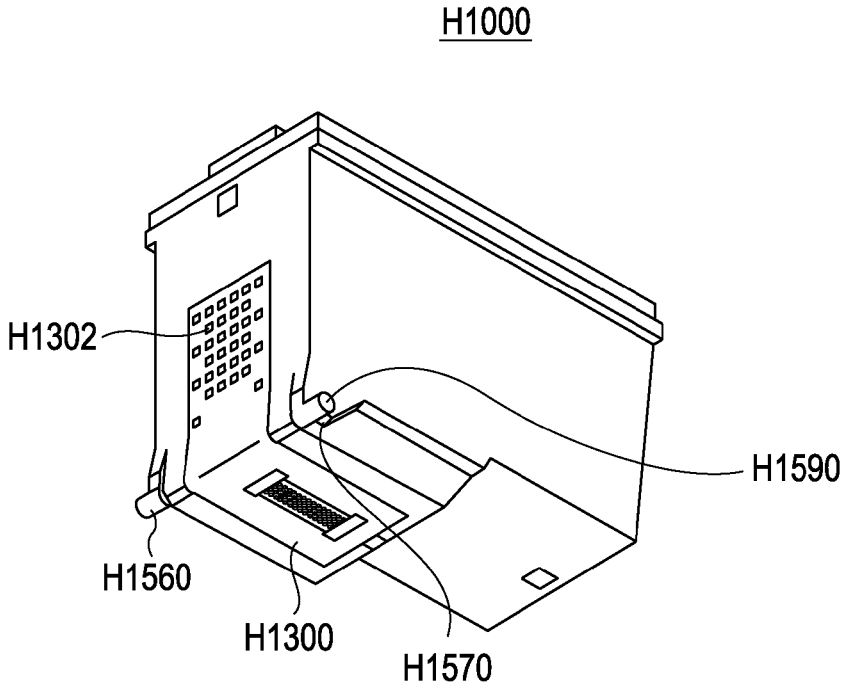
FIG. 7A is a perspective view of the appearance of a recording head viewed from the element-substrate side.
Figure 7B:
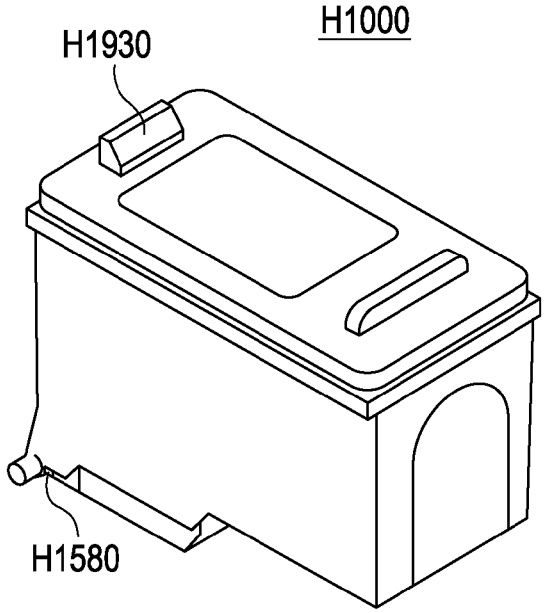
FIG. 7B is a perspective view of the appearance of the recording head.
Figure 9:
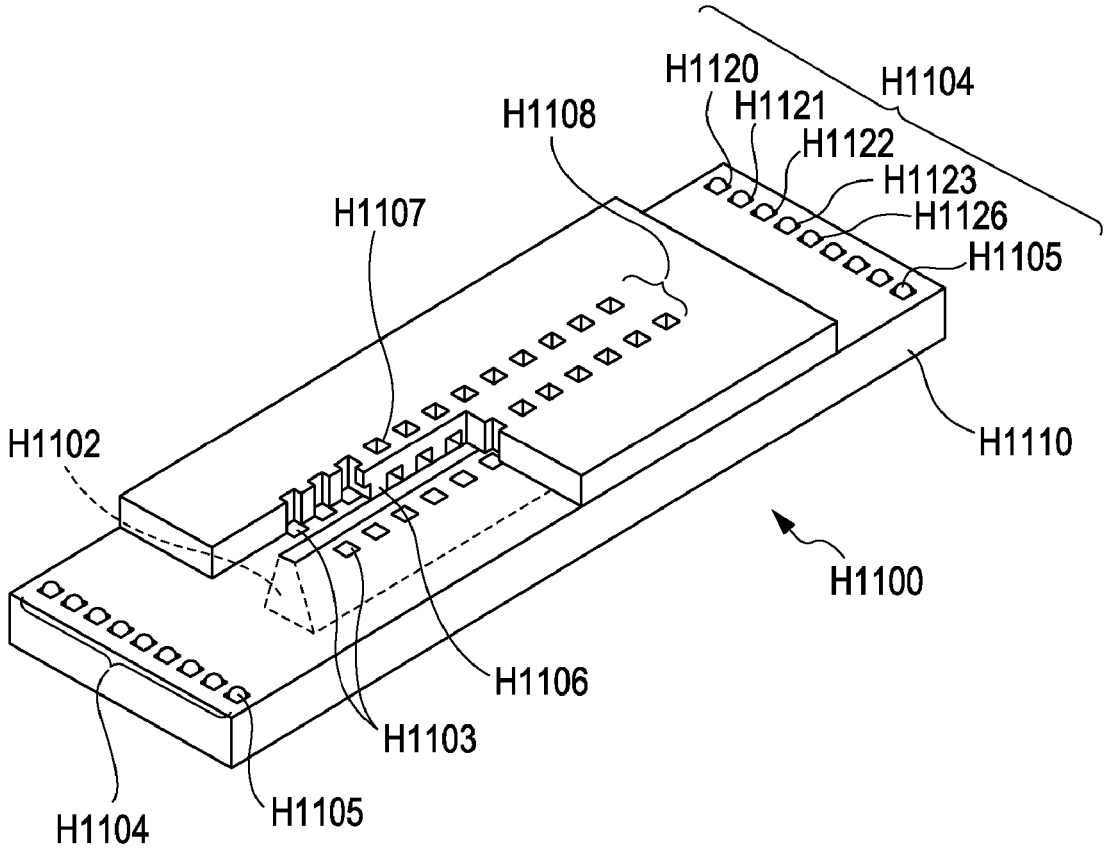
FIG. 9 is an outward perspective view of a recording element substrate of the recording head.

The recording head of the above-described embodiment includes a head chip including a recording element substrate provided with ejection orifices and an ink tank, where the head chip and the ink tank are integrated into each other. FIGS. 7A and 7B show the first black ink-filled recording head H1000. According to another embodiment of the present invention, a recording head H1001 (shown in FIG. 10) that is filled with color ink (cyan ink, magenta ink, and yellow ink) and that is provided with a recording element substrate provided with ejection orifices, where each of the ejection orifices is formed for one of the above-described colors. As shown in FIG. 9, each of the above-described recording heads is fixed and supported on a carriage 102 mounted on the main body of the inkjet recording apparatus through a positioning unit and electrical contact points. Further, each of the recording heads can be mounted and/or removed on and/or from the carriage 102. When the ink with which the recording head is filled is consumed and lost, the recording head can be replaced with another.

Hereinafter, each of the components of the recording head H1000 will be described in detail, for example.

The recording head H1000 is a bubble-jet (registered trademark) type recording head using an electrothermal conversion member generating thermal energy used to cause film boiling for the ink based on an electrical signal. More specifically, the recording head H1000 is a so-called side-shooter type recording head having the electrothermal conversion member opposed to ink ejection orifices.

Figure 8A:
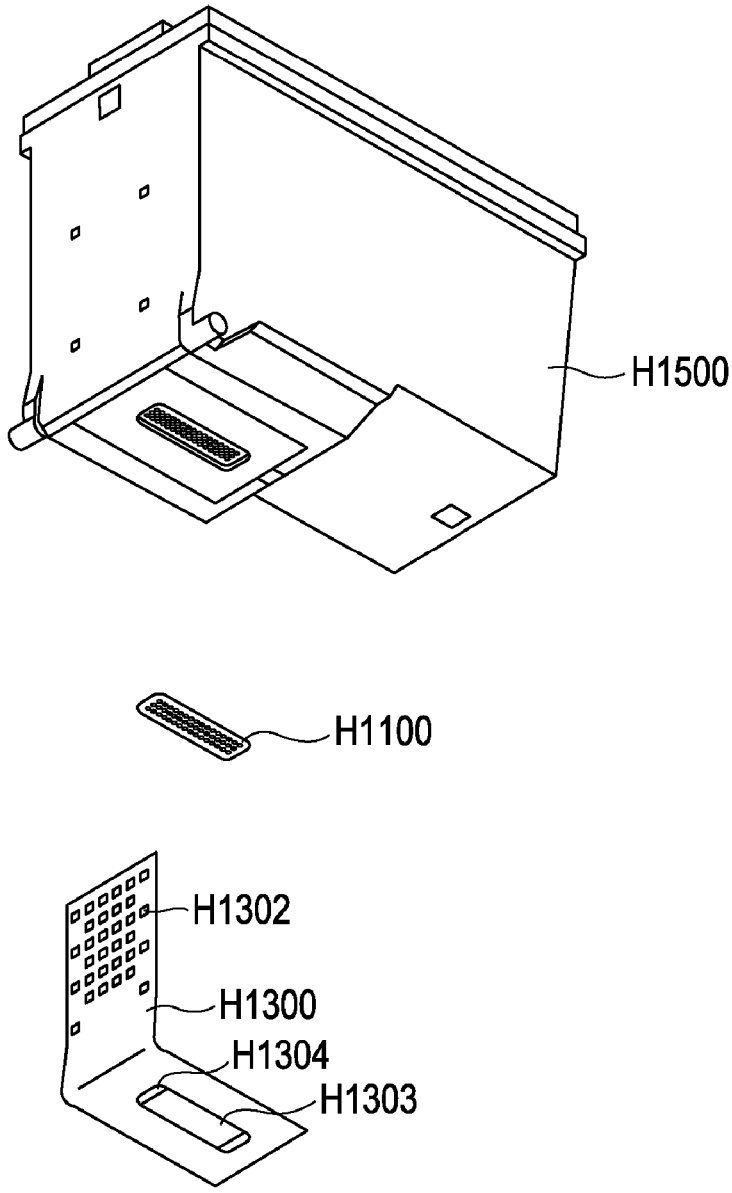
FIG. 8A is an exploded perspective view of the configuration of the recording head viewed from the element-substrate side.
Figure 8B:
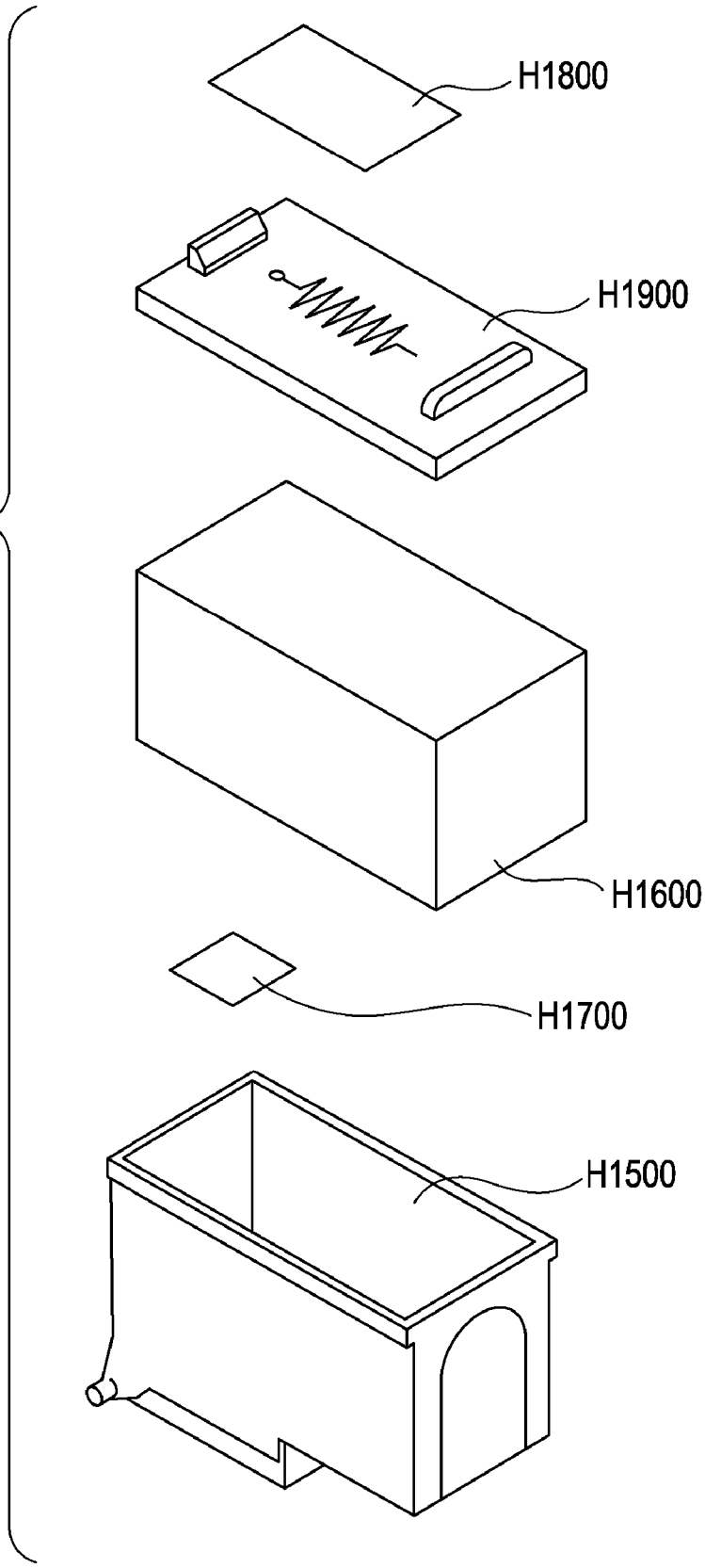
FIG. 8B is an exploded perspective view showing the configuration of the recording head.

Each of FIGS. 8A and 8B is an exploded perspective view of the recording head H1000. The recording head H1000 includes a recording element substrate H1100, an electrical wiring tape H1300, an ink supply retaining member H1500, a filter H1700, an ink absorber H1600, a covering member H1900, and a sealing member H1800. The electrical wiring tape H1300 is provided with a plurality of external signal input ends H1302 that are the points of electrical contact with the main body of the recording apparatus.

(Recording Element Substrate H1100)

FIG. 9 is a partially cutaway perspective view of the recording element substrate H1100, which is provided to illustrate the configuration of the recording element substrate H1100. The recording element substrate H1100 includes, for example, an Si substrate H1110 having a thickness of from 0.5 mm to 1 mm and an ink-supplying port H1102 provided in the Si substrate H1110, where the ink-supplying port H1102 is a long-channel like through hole provided as an ink path.

On the Si substrate H1110, a row of electrothermal conversion elements H1103 is arranged on each of both sides of an ink-supplying port H1102 so that the ink-supplying port H1102 is sandwiched between the rows of the electrothermal conversion elements H1103. Further, electrical wiring (not shown) including Al or the like is formed on the Si substrate H1110, so as to supply power to the electrothermal conversion elements H1103. The above-described electrothermal conversion elements H1103 and the electrical wiring can be formed by using known film-forming technologies. The rows of the electrothermal conversion elements H1103 are provided so that two rows of the staggered electrothermal conversion elements H1103 are arranged. Namely, the two rows are slightly shifted from one another so that the positions of the ejection orifices of one of the rows do not intersect those of the ejection orifices of the other row in the row direction.

Further, electrode parts H1104 are provided on the Si substrate H1110, so as to supply power to the electrical wiring and/or transmit electrical signals used to drive the electrothermal conversion elements H1103. The above-described electrode parts H1104 are arranged along each of the sides of the positions of the both ends of the rows of the electrothermal conversion elements H1103. Further, a bump H1105 including Au or the like is formed on each of the electrode parts H1104.

The bump H1105 is a generic name for signal input ends H1120, H1121, H1122, H1123, H1124, H1125, and H1126 that are provided to transmit signals to a recording element substrate which will be described later with reference to FIG. 1.

On one of the faces of the Si substrate H1110, the patterns of wiring and a storage element such as a resistor element are formed. On the above-described face, a structure including a resin material, the structure being provided with an ink path for each of the electrothermal conversion elements H1103, is formed through photolithography technologies. The above-described structure includes an ink-path wall H1106 dividing the ink paths and a ceiling part covering the upper part of the ink-path wall H1106. The ceiling part is provided with ejection orifices H1107 opposed to the electrothermal conversion elements H1103 so that an ejection-orifice group H1108 is formed.

In the above-described recording element H1100, ink supplied from the ink path H1102 is ejected from the ejection orifices H1107 opposed to the electrothermal conversion elements H1103. The above-described ink ejection is achieved through the pressure of air bubbles generated by heat produced by the electrothermal conversion elements H1103.

(Electrical Wiring Tape H1300)

The electrical wiring tape H1300 is provided to form an electrical signal path used to apply an electrical signal used to eject ink to the recording element substrate H1100. Further, an opening H1303 used to incorporate the recording element substrate H1100 is formed on the electrical wiring tape H1300. An electrode end H1304 connected to the electrode parts H1104 of the recording element substrate is provided near the edge of the opening H1303. Further, external signal input ends H1302 that are used to receive electrical signals transmitted from the main body of the apparatus are provided on the electrical wiring tape H1300. The above-described external signal input ends H1302 and the electrode end H1304 are connected to each other via a continuous wiring pattern made of copper foil.

The electrical connection between the electrical wiring tape H1300 and the recording element substrate H1100 is achieved by electrically bonding the bumps H1105 provided on the recording element substrate H1100 to the electrode end H1304 of the electrical wiring tape H1300 according to a thermo ultrasonic compression bonding method.

<Inkjet Recording Apparatus>

Figure 10:
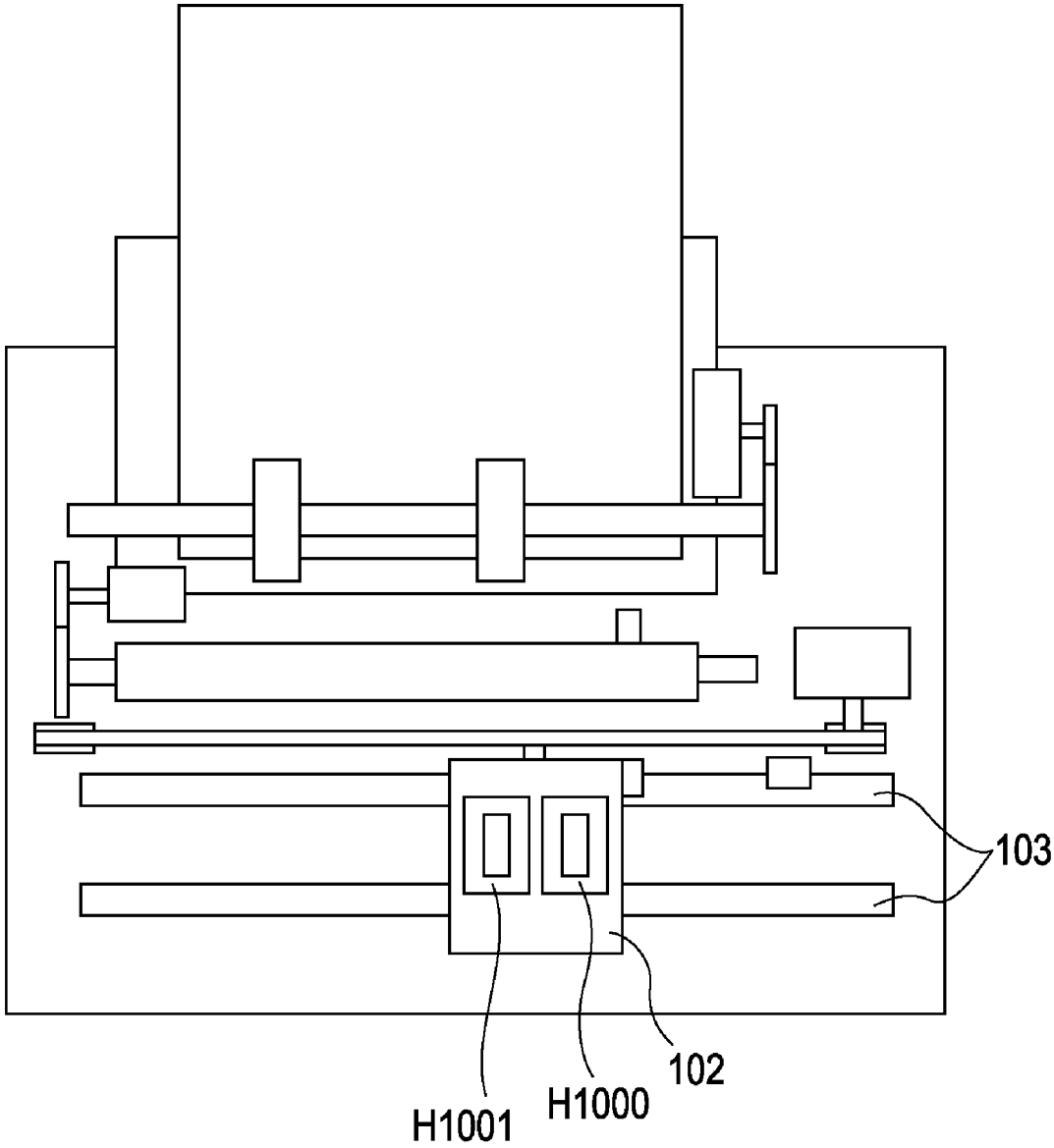
FIG. 10 is a diagram illustrating a recording apparatus on which a recording head according to an embodiment of the present invention can be mounted.

Next, a liquid ejecting recording apparatus on which the above-described cartridge-type recording head can be mounted will be described. FIG. 10 is a diagram illustrating an exemplary recording apparatus on which an inkjet recording head according to an embodiment of the present invention can be mounted.

The above-described recording apparatus includes a carriage 102 on which each of the recording head H1000 used for black ink and the recording head H1001 used for color ink is mounted at a predetermined position in a changeable manner. The carriage 102 is provided with an electrical connection part used to transmit drive signals or the like to the electrothermal conversion elements of ejection parts via the external signal input ends H1302 provided on the recording head H1000 and the electrode parts H1104 connected to the external signal input ends H1302.

The carriage 102 is supported so that the carriage 102 can reciprocate along a guide shaft 103 that is installed on the main body of the apparatus and extended in the main scanning direction.

The recording head H1001 is mounted on the carriage 102 so that the direction in which the ejection orifices of the ejection parts are arranged intersects the scanning direction of the carriage 102. Liquid is ejected from the above-described rows of ejection orifices so that data is recorded.

How the recording head H1000 is mounted on the inkjet recording apparatus will be specifically described.

As shown in FIGS. 7A and 7B, the recording head H1000 is provided with a mounting guide H1560 by which the recording head H1000 is guided to the mounting position of the carriage of the main body of the inkjet recording apparatus. Further, the recording head H1000 is provided with an engaging part H1930 including a head-set lever used to mount and fix the recording head H1000 onto the carriage 102. Still further, the recording head H1000 includes a butting part H1570 provided for the carriage's scanning direction, a butting part H1580 provided for the recording-medium transportation direction, and a butting part H1590 provided for the ink ejection direction that are used to mount the recording head H1000 on a mounting position predetermined on the carriage 102. The position of the recording head H1000 is determined due to the above-described butting parts so that the external signal input ends H1302 that are provided on the electrical wiring tape H1300 can be brought into electrical contact with contact pins of the electrical connection part provided in the carriage 102 with precision.

<Circuit Configuration of Recording Head>

Hereinafter, the circuit configuration of a recording head according to an embodiment of the present invention will be described. Particularly, a connection-state output circuit used to confirm the state of a connection between the recording head and the main body of the recording apparatus will be described.

First Embodiment

Figure 1:
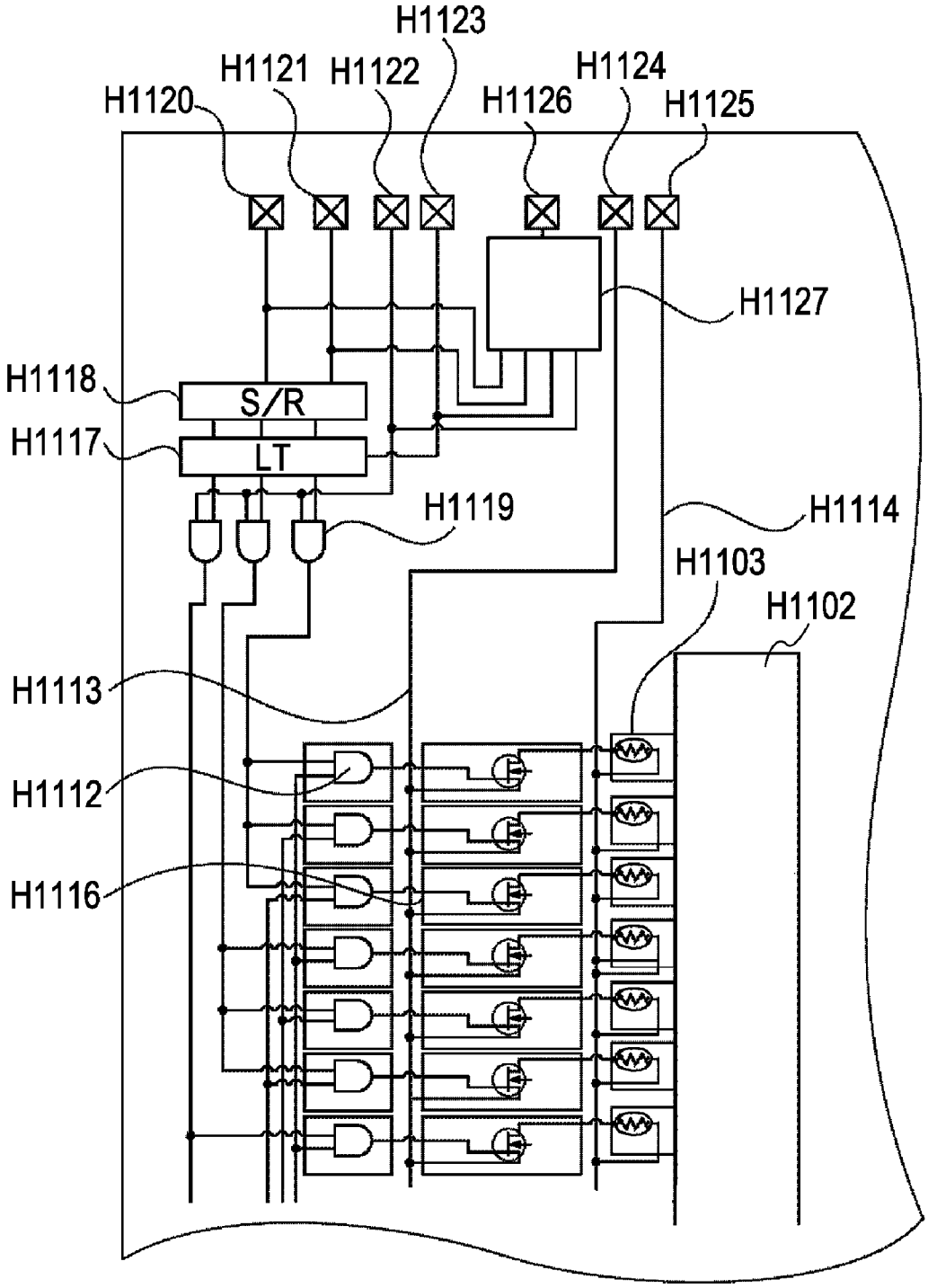
FIG. 1 is a diagram showing a circuit configuration provided on a recording element substrate of a recording head according to a first embodiment of the present invention.

FIG. 1 is a diagram showing a circuit configuration provided on the recording element substrate H1100 of the recording head H1000 according to a first embodiment of the present invention. Here, the recording element substrate H1100 is achieved by providing a semiconductor element and wiring on the Si substrate H1110 by performing semiconductor processing. The recording head H1100 according to the above-described embodiment is provided with a row of n nozzles for the ink-supplying port H1102. The electrothermal conversion elements H1103 used to heat ink existing in each of the nozzles and drive elements (driver transistors) H1116 driving the electrothermal conversion elements 1103 are provided. The above-described electrothermal conversion elements H1103, drive elements H1116, and nozzles are collectively referred to as recording elements.

Each of an end provided to transmit record data (DATA) and an end provided to input a clock signal (CLK) is provided on the recording element substrate H1100, as the points of electrical contact between the recording element substrate H1100 and the main body of the recording apparatus. Further, each of ends provided to transmit two signals including a latch signal (LT) used as a control signal and an electrothermal-conversion-member drive signal (HE) is provided on the recording element substrate H1100. Hereinafter, the electrothermal conversion member will be described as a heater. In FIG. 1, the input ends include a record-data input end H1121, a clock-signal input end H1120, a latch-signal input end H1123, and a drive-signal input end H1122. Further, the recording head including the recording element substrate shown in FIG. 1 adopts divided driving so that n recording elements are divided into at least two blocks and driven.

As shown in FIG. 1, a connection-state confirmation circuit H1127 and an output end H1126 of the connection-state confirmation circuit H1127 are provided. Further, a heater-drive-voltage input end H1124 used to supply a drive voltage to a heater-drive-voltage line H1113 and a ground (GND) end-for-heater H1125 connected to a GND line H1114 are provided. A shift resistor H1118 is provided to sequentially shift recording signals transmitted from the main body of the recording apparatus to the recording element substrate via the record data input end H1121 based on clock signals transmitted from the clock-signal input end H1120. A latch circuit H1117 is provided to retain a signal output from the shift resistor H1118, and each of logic circuits H1119 and H1112 is provided to select a drive element for driving. The ends H1120 to H1125 provided to achieve connections are included in the electrode parts H1104 that are shown in FIG. 9.

The above-described recording head is driven by performing the following processing procedures.

Record data items are transmitted from the record-data input end H1121 in synchronization with a clock signal transmitted from the clock-signal input end H1120. The transmitted record data items are stored in the shift resistor H1118 in sequence. When predetermined-bit record data is transmitted and stored in the shift register H1118, a latch signal is transmitted to the latch-signal input end H1123. The latch circuit H1117 provided in a stage subsequent to that of the shift register H1118 latches record data stored in the shift register H1118 at the time when the latch signal is transmitted to the latch-signal input end H1123.

Further, part of the record data is transmitted to a decoder (not shown) as a block selecting signal (BLE) used to divide and drive n electrothermal conversion elements H1103. Of the recording elements selected based on the block selecting signals, a logical product of a drive signal transmitted to the heater-drive-signal input end H1122 and record data transmitted from the latch circuit H1117 is calculated by an AND circuit H1119. After that, the recording element (heater) H1103 which is actually selected is driven by a signal transmitted from the AND circuit H1119. Ink is ejected from the nozzle of the driven recording element so that recording operations are performed.

Next, processing procedures performed according to the first embodiment, so as to confirm the state of the electrical connection between the recording head H1000 and the main body of the recording apparatus, will be described.

The recording head H1000 is mounted on the carriage 102 of the main body of the recording apparatus, as shown in FIG. 10. The carriage 102 includes a contact part (not shown) having an electrical contact point provided to connect to the external signal input ends H1302 of the recording head H1000. Therefore, when the recording head H1000 is mounted on the carriage 102, the electrical contact point of the carriage 102 is brought into contact with the external signal input ends H1302 that are provided on the recording head H1000 and that are configured to transmit and/or accept various electrical signals so that an electrical connection is achieved.

In the above-described embodiment, the connection-state confirmation circuit H1127 is provided on the recording element substrate H1100 of the recording head H1000, as a unit configured to confirm the state of an electrical connection between the recording head H1000 and the main body of the recording apparatus. A signal externally transmitted from the connection-state confirmation circuit H1127 is transmitted to the main body of the recording apparatus via the output end H1126 (CNO).

Figure 2:
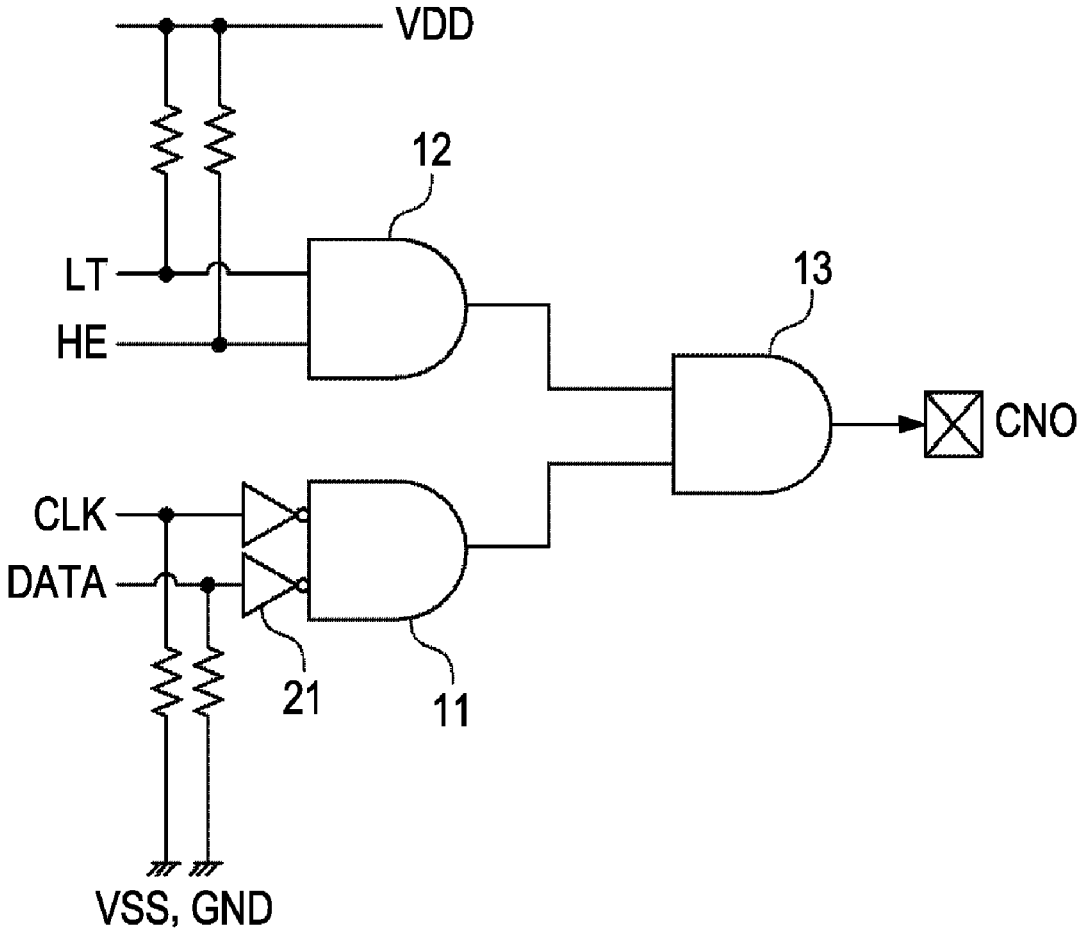
FIG. 2 is a diagram illustrating the configuration of a connection-state output circuit according to the first embodiment.

FIG. 2 is a circuit diagram showing the above-described connection-state confirmation circuit H1127 (CNO circuit) in detail. The connection-state confirmation circuit H1127 of the above-described embodiment includes three AND circuits. The first AND circuit 11 calculates a logical product of a record signal (DATA) and a clock signal (CLK). The second AND circuit 12 calculates a logical product of a latch signal (LT) and a drive signal (HE). The third AND circuit 13 calculates a logical product of the calculation result obtained by the first AND circuit 11 and that obtained by the second AND circuit 12. The output end H1126 is a connection-state output end provided to externally transmit data of the calculation result obtained by the connection-state confirmation circuit H1127.

Here, the record signal (DATA) and the clock signal (CLK) are inverted by an inverter 21 before being transmitted to the second AND circuit 12. The signal externally transmitted from the third AND circuit 13 is transmitted from the connection-state output end (CNO) H1126 to the main body of the recording apparatus. According to the connection-state confirmation circuit H1127, a signal externally transmitted from the connection-state output end H1126 is activated when the same logic as that used when record data and input signals that are transmitted from the input ends are pulled up and/or pulled down is used.

Figure 3:
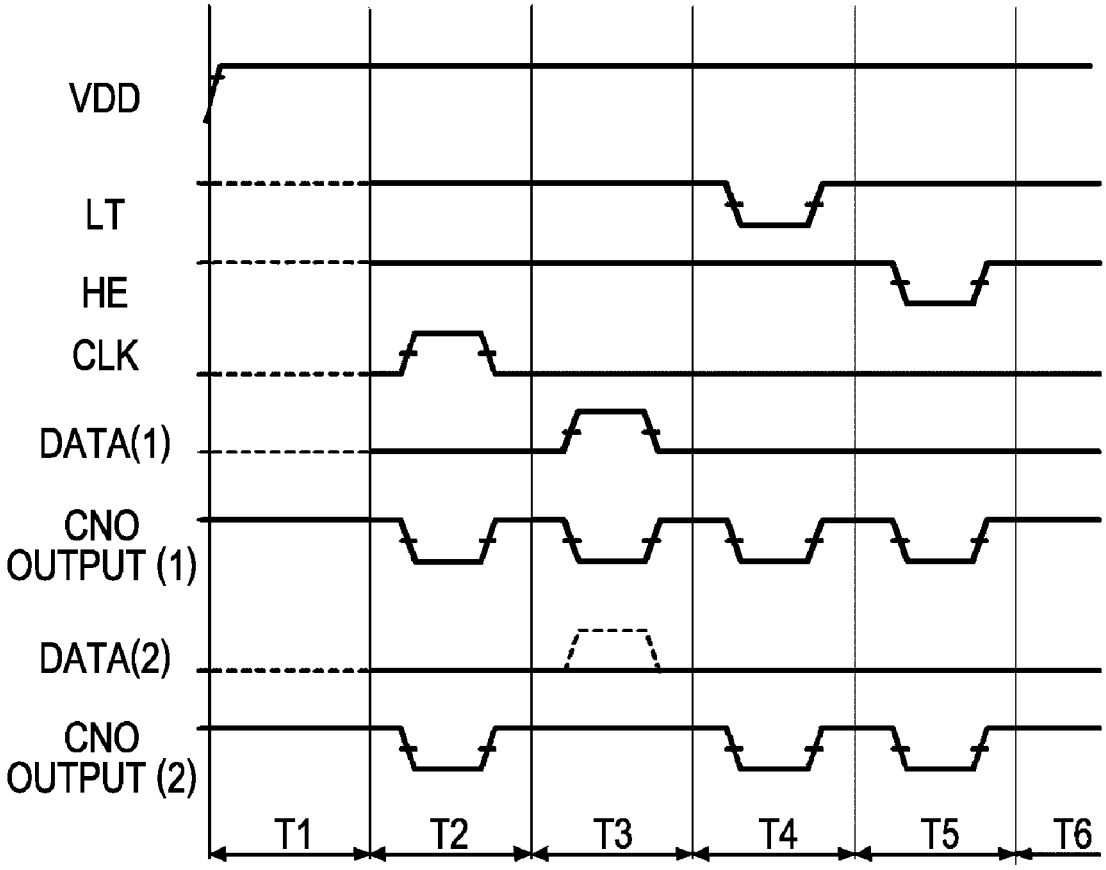
FIG. 3 is a timing chart provided to confirm the connection states obtained in the first embodiment.

FIG. 3 is a timing chart showing the state of each of signals transmitted from the recording apparatus to the recording head when the state of a connection between the recording head and the main body of the recording apparatus is confirmed, and an output signal (CNO output) externally transmitted from the connection-state output end H1126.

Here, each of the latch signal (LT) and the drive signal (HE) that are provided as control system signals is a digital signal of a negative logic (low active) of which signal is turned on at a low level. According to the negative logic, when there is no signal, that is, when the logic indicates "false (0)", the level is increased through a pull-up resistor, so as to achieve a higher level. When the logic indicates "true (1)", the level becomes low.

The reason why the above-described configuration is achieved is described below. Namely, the circuit includes a transistor-transistor logic (TTL) circuit before a complementary metal oxide semiconductor (CMOS) is used as a semiconductor element, and when the TTL circuit is driven at 5V, the range identified as the low level by the TTL circuit is small. The TTL circuit is a transistor-transistor logic circuit performing the same operations as those performed by widely available SN74AS163. More specifically, the high-level area is the range extending from 5V to 3V, and the low-level area is the range extending from 0V to 0.8V or around.

On the other hand, each of the record signal (DATA) and the clock signal (CLK) is a positive-logic (high active) digital signal which is turned on at a high level. A connection to a pull-down resistor is established so that a ground (GND) level is obtained when there is no signal. This is because when each signal is a positive logic signal, the signal system is shorted out and/or a malfunction occurs in the power-supply system, and when each signal becomes a high-level signal, it becomes difficult to perform drive control for the recording signals. In the first embodiment, signals of different logics are used, so as to avoid the above-described problems. Since noise margins are usually effective, the latch signal and the heater-drive signal, which are the control system signals, are determined to be negative-logic signals, and the clock signal and the record signal are determined to be positive-logic signals.

In the first embodiment, it is determined whether each of the input ends is open. First, during the first period T1 shown in FIG. 3, a power supply voltage VDD which is a logic system power supply is transmitted from the main body of the recording apparatus to the recording head, and the other logic signal ends are determined to be open. In the period T1 shown in FIG. 3, a signal indicated by a broken line indicates that the end is open, and the signal level corresponds to each of logic signals through the pull-up resistor and the pull-down resistor.

When the logic signal end is open, the CNO output becomes active and a high-level signal is output under the influences of the pull-up logic and the pull-down logic. Consequently, the connection of the VDD which is a logic-power-supply end can be confirmed. Here, the logic power supply VDD maintains the high-level signal until the fifth period T5 comes.

Next, the clock signal (CLK) is changed into a high-level signal in the second period T2. If a signal having a level lower than that of a CNO output is externally transmitted in that state, the electrical connection of the clock signal end is confirmed. Next, the clock signal is changed back to a low-level signal and the record signal (DATA (1)) is changed into a high-level signal. If a signal having a level lower than that of a CNO output (1) is externally transmitted in that state, the electrical connection of the record signal end is confirmed.

Next, the record signal (DATA (1)) is changed back to a low-level signal in the fourth period T4 and the latch signal (LT) is changed into a low-level signal. If a signal having a level lower than that of the CNO output (1) is externally transmitted in that state, the electrical connection of the latch signal end is confirmed. Next, the latch signal is changed back to a high-level signal in the fifth period T5 and the drive signal (HE) is changed into a low-level signal. If a signal having a level lower than that of the CNO output (1) is externally transmitted in that state, the electrical connection of the drive signal end is confirmed. After that, the drive signal (HE) is changed back to a high-level signal in the sixth period T6 and the connection-state confirmation processing is finished.

The first embodiment allows for determining an open end. Hereinafter, the following case will be considered. Namely, when the record signal (DATA) end is open, a high-level signal is transmitted to the record-signal end (indicated by a broken line as shown in FIG. 3), so as to perform the connection confirmation, as is the case with a signal DATA (2) shown in FIG. 3. Since a DATA-signal line is in the open state, the low level is maintained in the record substrate through the pull-down resistor (indicated by the solid line corresponding to the signal DATA (2)).

At that time, a CNO output (2) shown in FIG. 3, which is the output of the connection-state confirmation circuit H1127, is maintained at a high level, and the CNO output remains constant before and after a signal (2) is transmitted from a DATA end. Thus, the bad connection (open) of the record signal (DATA (2)) can be determined. Similarly, input signals are varied from one input end to another, and the difference between the output and/or the level of an output signal of the connection-state confirmation circuit H1127, which is obtained before the signal is transmitted, and the output and/or the level of the output signal of the connection-state confirmation circuit H1127, which is obtained after the signal is transmitted, is studied. Consequently, it becomes possible to determine whether a bad connection occurs for each end.

Figure 4:
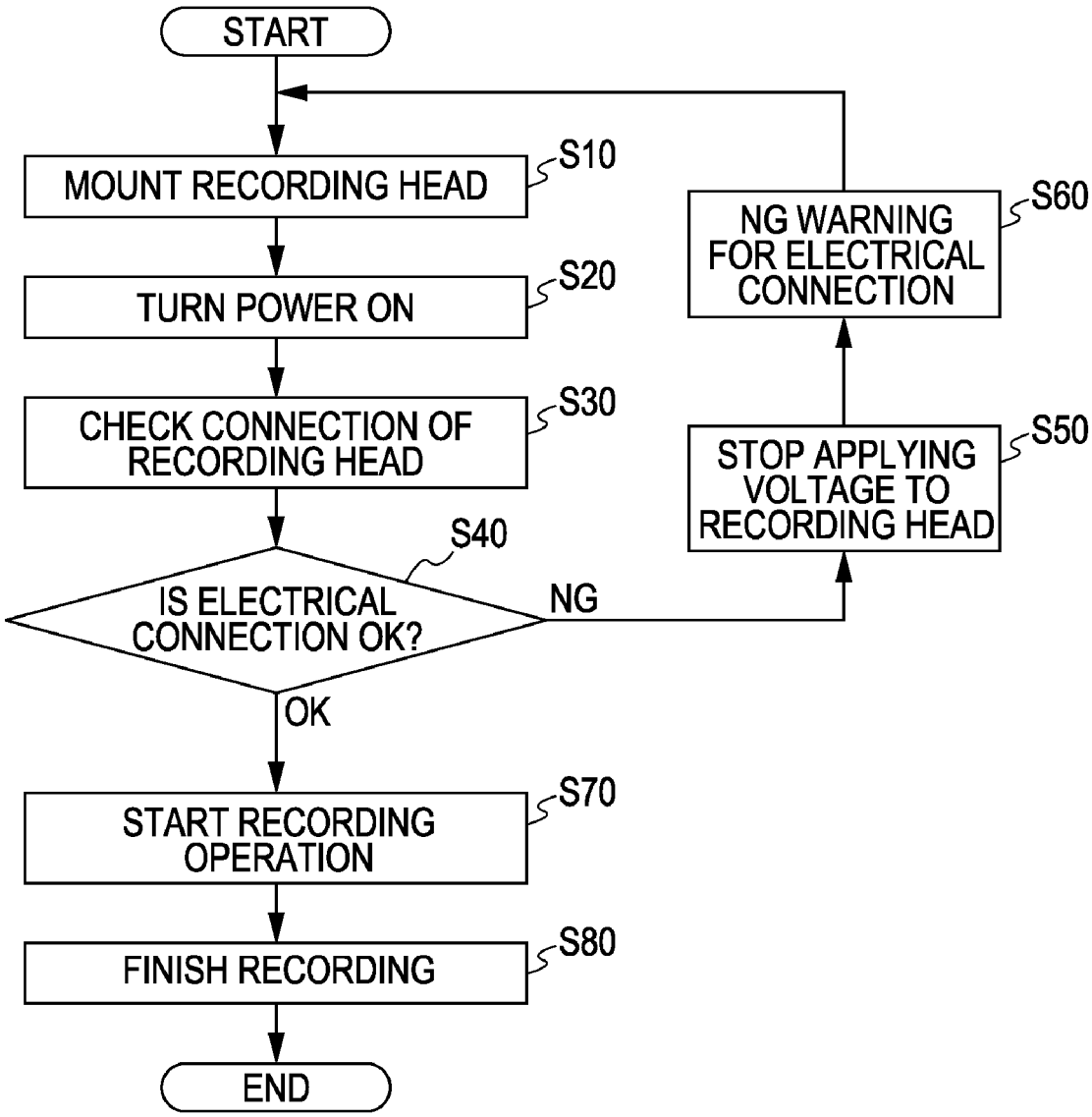
FIG. 4 is a flowchart provided to confirm the connection state in the inkjet recording apparatus.

FIG. 4 is a flowchart showing processing procedures performed to confirm the connection state of each of the input ends of an inkjet recording head according to the above-described embodiment by using a recording apparatus on which the inkjet recording head is mounted.

At step S10, the recording head is mounted on the carriage of the recording apparatus. Next, at step S20, the power of the recording apparatus is turned on. Next, a check is made at step S30, so as to determine whether the recording head is successfully connected to the recording apparatus. More specifically, it is confirmed whether the electrical connection between the input ends of the recording head and the recording apparatus is successful or unsuccessful. A signal is transmitted from the main body of the recording apparatus to each of the input ends (H1120 to H1123) of the recording head via the external-signal input ends H1302 of the recording head.

Here, the signal may be transmitted to any of the input ends so long as a user wishes to confirm the connection state of the input end. The recording apparatus stores the data of a mode of transmitting a connection-state confirmation signal to the recording head. The above-described confirmation signal is transmitted to a single predetermined input end. Control is performed so that the above-described confirmation signal is not transmitted to the other input ends and data of the result of calculating the confirmation signal through the connection-state output circuit is externally transmitted from the connection-state output end. It may be configured that the confirmation signals are transmitted to the individual input ends in sequence.

The level of each of the input signals is varied as described above, and a signal output from the output end H1126 of the connection-state confirmation circuit H1127 is confirmed. The connection-state confirmation signal may be a pulse signal specifically designed for confirming the connection. Further, part of signals originally transmitted to the individual ends may be used as the connection-state confirmation signal.

When the electrical connection of each of the ends of the recording head is not successful, the application of voltages to the recording head is stopped at step S50. Further, a warning indicating that the electrical connection is not successful (unsuccessful) is issued at step S60. The above-described warning is issued, so as to notify the user of the recording apparatus that the electrical connection is not successful, by lighting a light-emitting diode (LED) provided on the recording apparatus, displaying a message through a host apparatus, etc.

When the message is displayed for each of the input ends, it becomes possible to determine which end is in an unsuccessful connection state and issue a warning. Further, the method of lighting the LED can be changed according to whether the connection is shorted out or open. When the electrical connection is successful, the recording operations are started at step S70. After desired recording is performed, the recording operations are finished at step S80.

In the above-described embodiment, the recording head has been described. However, an inkjet-recording-head cartridge including a recording head integrated into an ink tank may be used, so long as the above-described circuit is used therefor. Thus, the connection state of each of the input ends can be determined.

Second Embodiment

Figure 5:
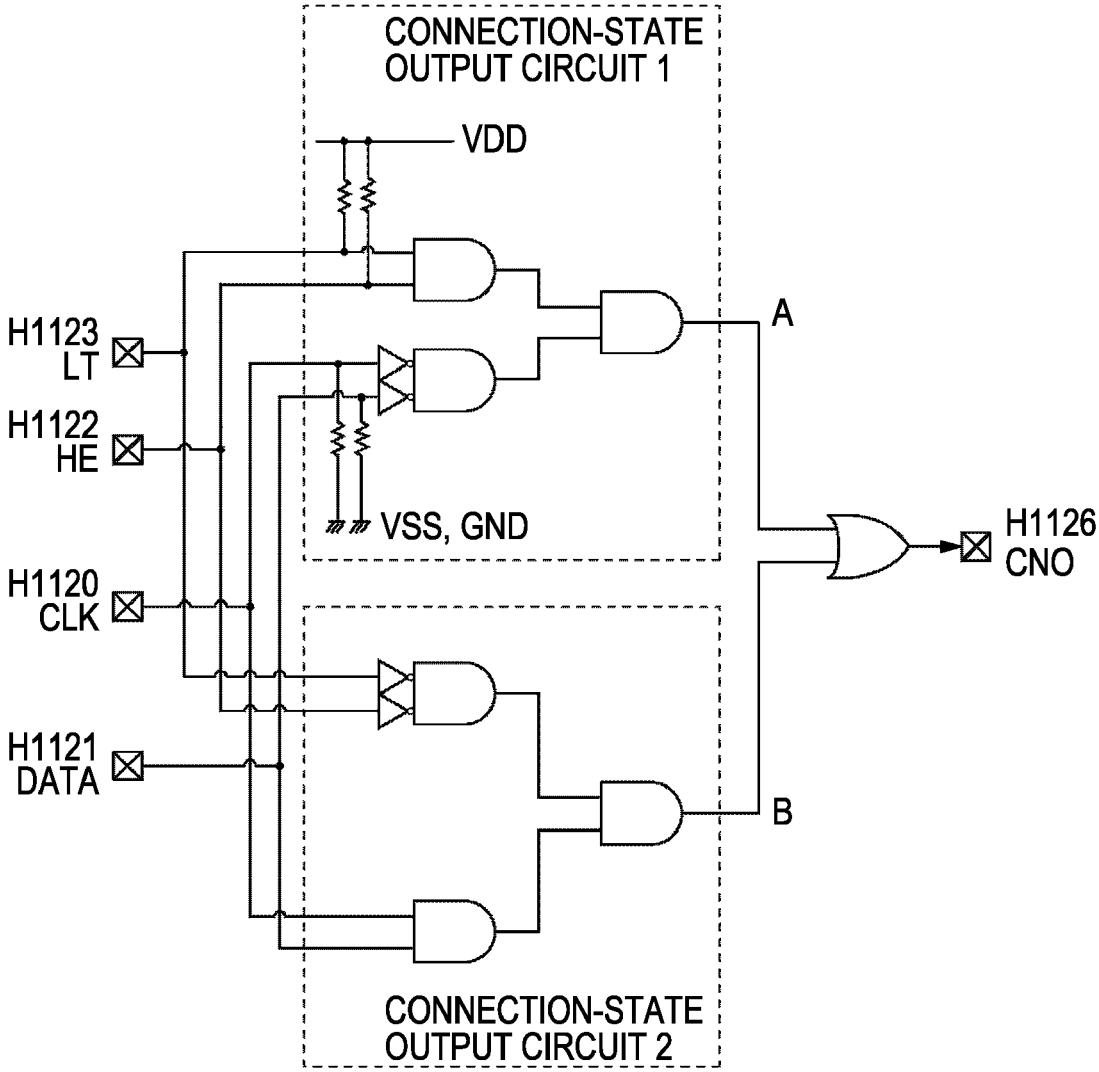
FIG. 5 is an illustration of the configuration of a connection-state output circuit according to a second embodiment of the present invention.

Next, a second embodiment of the present invention will be described with reference to FIG. 5. In the first embodiment, the signal-end determination can be made when each of input-signal ends is open. In the second embodiment, however, a defective end can be determined when a short occurs as well as when each of the input-signal ends is open. According to the circuit configuration of the second embodiment, a connection-state output circuit 1, which is the first connection-state output circuit indicated by a broken line as shown in FIG. 5, and a connection-state output circuit 2, which is the second connection-state output circuit indicated by another broken line as shown in FIG. 5, are provided. The connection-state output circuit 1 has the same circuit configuration as that illustrated in the first embodiment.

On the other hand, the input signal of the connection-state output circuit 2 is the inverse of that of the connection-state output circuit 1. The above-described connection-state output circuits 1 and 2 are parallel-connected from a latch signal end (LT) which is a logic input signal end, a heater-drive signal end (HE), a clock signal end (CLK), and a record data end (DATA).

An output A of the output circuit 1 and an output B of the output circuit 2 are connected to an OR circuit provided with two inputs, and data of the calculation result is transmitted to the CNO end H1126. The signals of the input ends are parallely transmitted to the two connection-state output circuits. An output B transmitted from the second connection-state output circuit is activated when a logic which is the opposite of the logic used when the record data and the input signals that are transmitted from the individual input ends are pulled up and/or pulled down is used.

Hereinafter, the circuit state where the individual logic input signal ends are shorted out will be described step by step. First, the case where the latch signal end (LT) is shorted out on the GND side will be described with reference to FIG. 6. Since the LT is shorted out in the connection-state output circuit 1, a low-level signal is obtained. At that time, an output A of the connection-state output circuit 1 becomes a low-level signal irrespective of input signals of the other ends. Further, in the connection-state output circuit 2, the input signal of the LT is inversed and transmitted to an AND circuit. Therefore, the AND circuit provided in the first stage becomes active.

Figure 6:
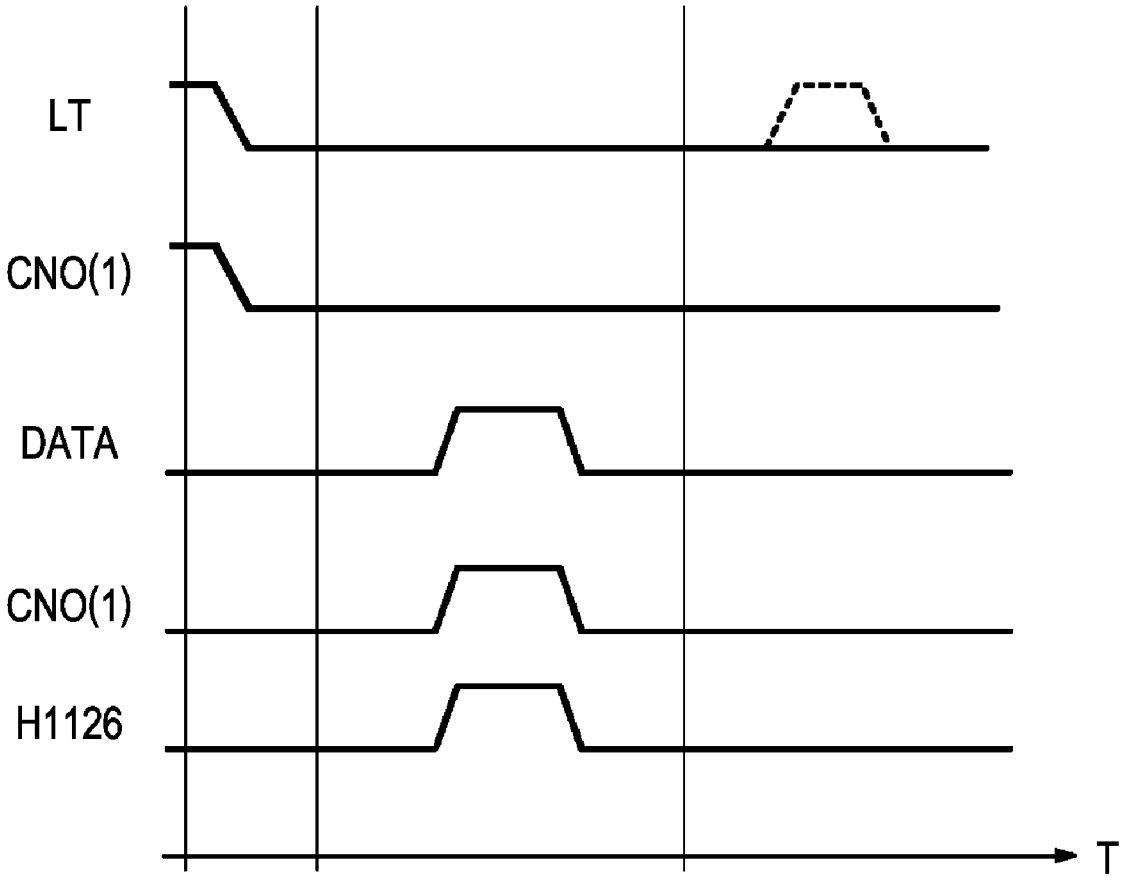
FIG. 6 is a timing chart relating to the connection-state output circuit according to the second embodiment.

In FIG. 6, when a high-level DATA signal is transmitted, for example, the output B of the connection-state output circuit 2 becomes a high-level signal. When the DATA signal is changed from the high-level signal to a low-level signal, the output B of the connection-state output circuit 2 is also changed from the high-level signal to the low-level signal, following the above-described processing. Thus, the output B of the connection-state output circuit 2 can be changed based on the input level of the other input signal end (in that case, a signal transmitted from DATA).

Here, a latch signal for inputting is changed from a low-level signal to a high-level signal as shown in FIG. 6, so as to confirm the connection state of the latch signal end. Since the line of the LT is shorted out on the GND side, a signal that should have been transmitted as indicated by a broken line shown in FIG. 6 is not transmitted in actuality. Namely, the signal of the LT is remained unchanged at the low level as shown by a solid line. As a result, even though an input signal of the latch signal end LT is changed, the output B of the connection-state output circuit 1 is not changed as shown in FIG. 6.

If the input state of each of the other input ends (DATA/CLK/HE) is not changed at that time, the output B of the connection-state output circuit 2 is not changed, so that the output of the output end H1126 is not changed. Therefore, it becomes possible to determine that the latch signal end has a bad connection.

Next, the case where the latch signal end (LT) is shorted out at a high level will be considered. The above-described case is the opposite of the above-described case where the latch signal end LT is shorted out on the GND side. Therefore, the AND circuit provided in the first stage, to which the latch signal of the connection-state output circuit 2 is transmitted, is activated and the output B of the connection-state output circuit 2 becomes a low-level signal.

On the other hand, in the connection-state output circuit 1, the AND circuit provided in the first stage, to which the latch signal is transmitted, is activated and the output A of the connection-state output circuit 1 can be changed based on the input level of the other input-signal end. At that time, even though the latch signal for inputting is changed, the output A is not changed so that the output B is remained at the low level and unchanged. As a result, the signal of the output end (CNO) H1126 is not changed. Thus, the bad connection of the latch signal end can be determined.

Thus, even though the latch signal end is shorted out on the GND side and/or at a high level, it can be determined that the connection is insufficient by confirming the state of a change in the output of the output end H1126. Further, the connection of the drive signal end (HE) can be confirmed by performing the same connection-confirmation sequence as that performed for the latch signal end.

Similarly, the case where the clock signal end (CLK) is shorted out on the GND side will be considered. The AND circuit provided in the first stage, to which the clock signal of the connection-state output circuit 2 is transmitted, is activated and the output B of the connection-state output circuit 2 becomes a low-level signal. On the other hand, in the connection-state output circuit 1, the AND circuit provided in the first stage, to which the clock signal is transmitted, is activated and the output A of the connection-state output circuit 1 can be changed based on the input level of the other input-signal end. At that time, the output A is not changed even though the clock signal for inputting is changed. As a result, the signal of the output end (CNO) H1126 is not changed and it becomes possible to determine a clock signal end with insufficient connection.

Next, the case where the clock signal end (CLK) is shorted out at a high level will be considered. In that case, in the connection-state output circuit 1, an inversed signal is transmitted to the AND circuit provided in the first stage, to which a CLK signal is transmitted. Namely, since the CLK signal is transmitted at a low level, the output A of the connection-state output circuit 1 becomes a low-level signal irrespective of the input signals of the other ends. Further, since the CLK signal for inputting is shorted out at a high level in the connection-state output circuit 2, the AND circuit provided in the first stage is activated and the output B of the connection-state output circuit 2 can be changed based on the input level of each of the other input signal ends.

At that time, the output B is not changed even though the clock signal for inputting is changed. As a result, therefore, the signal of the output end (CNO) H1126 is not changed and it becomes possible to determine that the connection state of the clock signal end is insufficient. As described above, even though the clock signal end is shorted out on the GND side and/or at a high level, it becomes possible to determine that the connection state is insufficient. Further, the connection state of the record data end (DATA) can be confirmed by performing the same connection-confirmation sequence as that performed for the clock signal end.

Thus, if the output of the output end H1126 is not changed even though the signals of the input ends are individually changed, it becomes possible to determine that the connection state of the input end is insufficient.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2008-118811 filed on Apr. 30, 2008, which is hereby incorporated by reference herein in its entirety.

What is claimed is:

1. An inkjet recording head that can be mounted on a recording apparatus in a removable manner, and that is provided with an element substrate including a plurality of recording elements, a record data input end provided to transmit record data, a clock signal input end provided to transfer the record data, a drive signal input end provided to transmit a drive signal used to control driving the recording element, and a latch signal input end provided to transmit a signal used to latch the record data through a latch circuit, the inkjet recording head comprising:

a first connection-state output circuit configured to externally transmit data of a state of a connection between the input ends and the recording apparatus based on signals transmitted from the recording apparatus via the input ends;

a second connection-state output circuit to which the signals transmitted to the input ends are further transmitted in parallel with the first connection-state output circuit;

a circuit to which both outputs from the first and second connection-state output circuits are transmitted; and a connection-state output end configured to externally transmit data of a result of a calculation performed through the circuit.

2. The inkjet recording head according to claim 1, wherein the first connection-state output circuit is a circuit configured to activate an output from the first connection-state output circuit when a logic equivalent to a logic used when the record data and the input signals that are transmitted from the input ends are pulled up and/or pulled down is used, and wherein the second connection-state output circuit is a circuit configured to activate an output from the second connection-state output circuit when a logic which is an opposite of the logic used when the record data and the input signals that are transmitted from the input ends are pulled up and/or pulled down is used.

3. An inkjet recording apparatus on which an inkjet recording head can be mounted in a removable manner, the inkjet recording head comprising:

an element substrate including a plurality of recording elements, a record data input end provided to transmit record data, a clock signal input end provided to transfer the record data, a drive signal input end provided to transmit a drive signal used to control driving the recording element, and a latch signal input end provided to transmit a signal used to latch the record data through a latch circuit;

a first connection-state output circuit configured to confirm a connection between the signal input ends and the recording apparatus based on signals transmitted from the signal input ends;

a second connection-state output circuit to which signals transmitted from the signal input ends are further transmitted in parallel with the first connection-state output circuit;

a circuit to which both outputs from the first and second connection-state output circuits are transmitted; and a connection-state output end configured to output data of a result of a calculation performed through the circuit, wherein it can be determined whether a state of a connection between each of the signal input ends and the recording apparatus is an open state or a shorting state.

4. An inkjet recording head, comprising:

a substrate including a plurality of recording elements, a first end to receive a data signal for recording, a second end to receive a clock signal, a third end to receive a drive signal for controlling driving the recording element, a fourth end to receive a latch signal for latching the data signal, and a fifth end to output a state signal; and a circuit unit including a pull up circuit configured to pull up the latch signal and the drive signal, a pull down circuit configured to pull down the clock signal and the data signal, an inverter configured to inverse the clock signal and the data signal, a first AND circuit configured to receive the latch signal and the drive signal that are pulled up by the pull up circuit, a second AND circuit configured to receive the clock signal and the data signal that are pulled down by the pull down circuit and are inversed by the inverter, and a third AND circuit configured to receive outputs from each of the first AND circuit and the second AND circuit and generates the state signal corresponding to a result of a logical multiplication by the third AND circuit.

5. The inkjet recording head according to claim 4, wherein each of the data signal and the clock signal is a positive-logic digital signal, and wherein each of the latch signal and the drive signal is a negative-logic digital signal.

6. An inkjet recording head, comprising:

a substrate including a plurality of recording elements, a first end to receive a data signal for recording, a second end to receive a clock signal, a third end to receive a drive signal for controlling driving the recording element, and a fourth end to receive a latch signal for latching the record data and a fifth end to output a state signal;

a pull up circuit configured to pull up the latch signal and the drive signal;

a pull down circuit configured to pull down the clock signal and the data signal;

a first circuit unit including an inverter configured to inverse the clock signal and the data signal, a first AND circuit configured to receive the latch signal and the drive signal that are pulled up by the pull up circuit, a second AND circuit configured to receive the clock signal and the data signal that are pulled down by the pull down circuit and are inversed by the inverter, a third AND circuit configured to receive outputs from each of the first AND circuit and the second AND circuit and generates a first state signal corresponding to a result of a logical operation by the third AND circuit;

a second circuit unit including an inverter configured to inverse the latch signal and the drive signal, a fourth AND circuit configured to receive the latch signal and the drive signal that are pulled up by the pull up circuit and are inversed by the inverter, a fifth AND circuit configured to receive the clock signal and the data signal that are pulled down by the pull down circuit, a sixth AND circuit configured to receive outputs from each of the fourth AND circuit and the fifth AND circuit and generates a second state signal corresponding to a result of a logical operation by the sixth AND circuit; and a OR circuit configured to receive outputs from each of the first circuit and the second circuit and generates the state signal corresponding to a result of a logical addition by the OR circuit.

* * * * *